United States Patent [19]

Gutridge

[11] 4,130,958

[45] Dec. 26, 1978

[54] GUN SIGHT

[76] Inventor: Jack E. Gutridge, 533 214th St., Dyer, Ind. 46311

[21] Appl. No.: 791,172

[22] Filed: Apr. 27, 1977

[51] Int. Cl.[2] ..... F41G 1/02

[52] U.S. Cl. ..... 42/1 S; 33/243

[58] Field of Search ..... 42/1 S; 33/243, 242, 33/233

[56] References Cited

U.S. PATENT DOCUMENTS

| | | | |
|---|---|---|---|
| 1,329,075 | 1/1920 | Fornonzini | 42/1 S |
| 1,718,458 | 6/1929 | Hager et al. | 42/1 S |
| 1,852,875 | 4/1932 | Endrezze | 33/243 |
| 2,672,127 | 9/1956 | Swett | 42/1 S |
| 3,230,654 | 1/1966 | Smith | 42/1 S |
| 3,264,771 | 8/1966 | Barnes | 42/1 S |
| 3,386,171 | 6/1968 | Luebkeman | 33/233 |
| 3,451,137 | 6/1969 | Hart | 42/1 S |
| 3,984,917 | 10/1976 | Korzeniewski | 42/1 S |
| 4,008,536 | 2/1977 | Adams | 42/1 S |

*Primary Examiner*—Charles T. Jordan

*Attorney, Agent, or Firm*—Robert E. Wagner; Gerald T. Shekleton; Thomas L. Kautz

[57] ABSTRACT

A front gun sight for use in combination with a conventional rear sight, including a front extended tapered sighting surface, having a center portion of a contrasting color to the side portions, allowing a quick and accurate aiming of the gun even under poor light conditions. The tapered sighting surface is secured to a tapered mount which itself may be attached on a gun barrel over an existing sight. The extended tapered sighting surface forms a linear sighting line allowing the rear sigt to be lined up with the top front of the tapered sighting surface to align the projectile path with the target.

5 Claims, 14 Drawing Figures

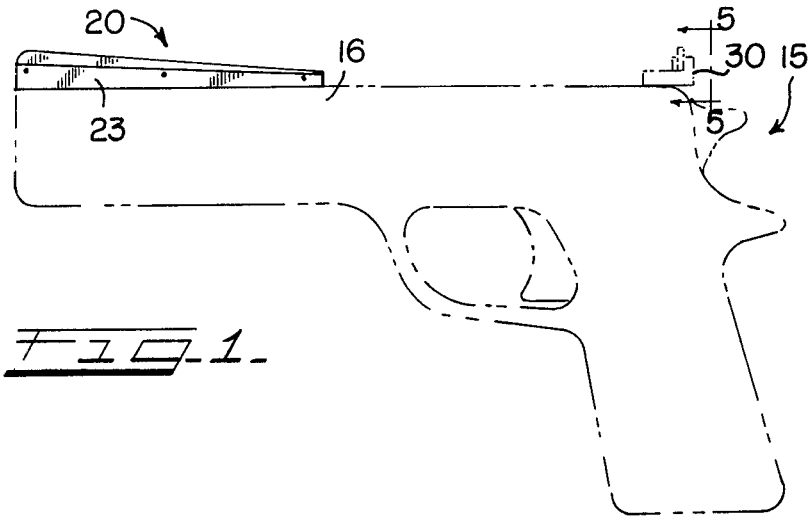
FIG. 1.
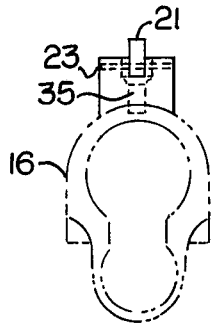
FIG. 4.
FIG. 2.
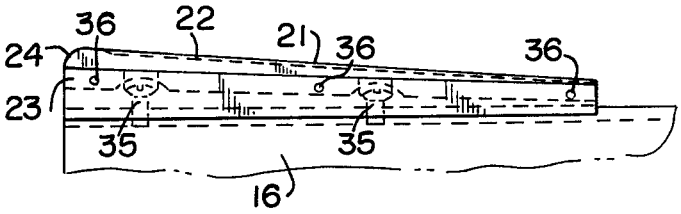
FIG. 3.
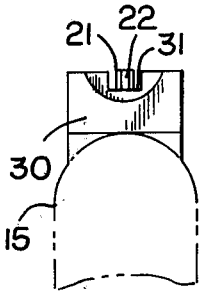
FIG. 5.
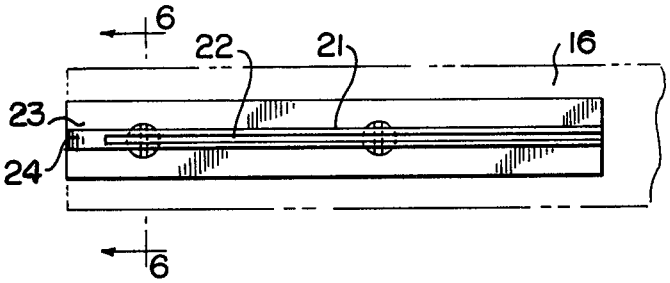
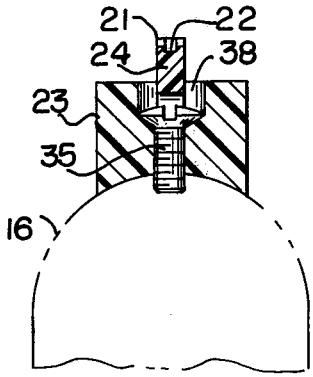
FIG. 6.
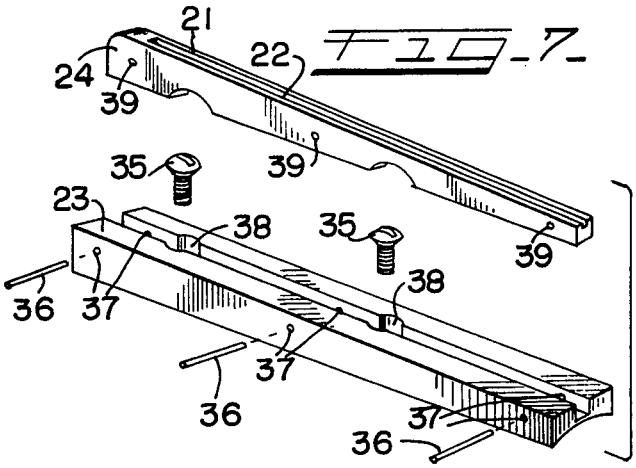
FIG. 7.

FIG. 8
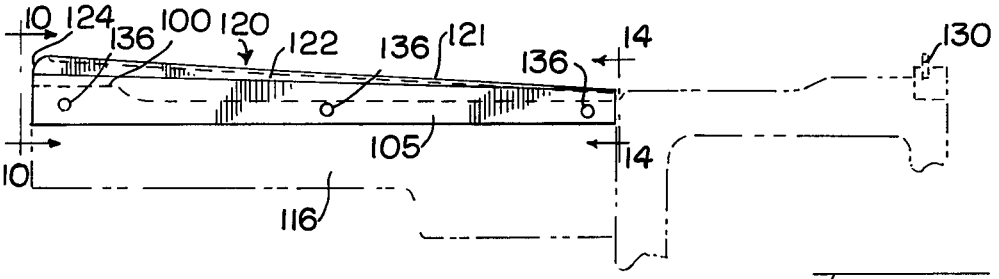
FIG. 9
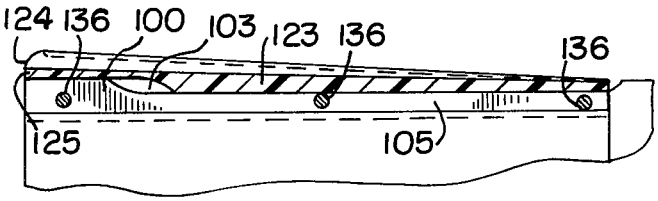
FIG. 10
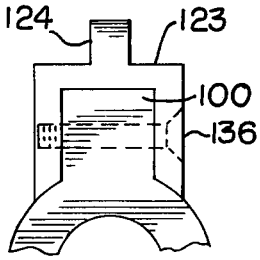
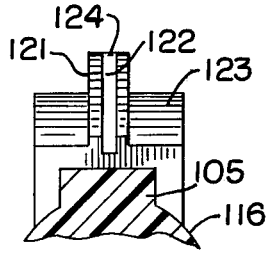
FIG. 11
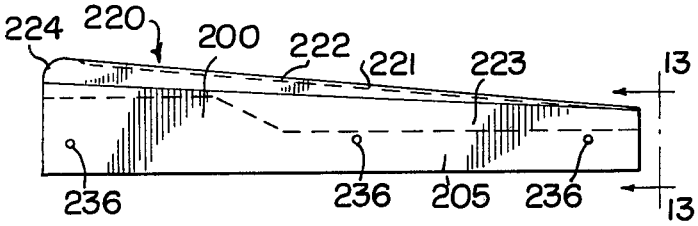
FIG. 14
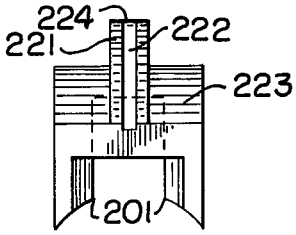
FIG. 12
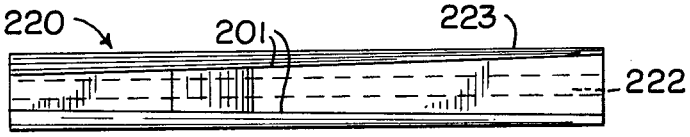
FIG. 13

GUN SIGHT

BACKGROUND OF THE INVENTION

This invention relates to a gun sight and, more particularly to gun sights for use on small arms such as pistols, rifles and the like.

Conventional gun sights of the open sight variety generally have two cooperating components. A notch or aperture rear sight is used to optically align two separate protrusions located at spaced intervals on the gun on a target. However, due to the size of the sighting blades generally employed and the spatial distance between these sights, a loss of time generally occurs when aligning the two sights and focusing on the target. Therefore, a fast and accurate shot is made difficult. Further, the target focused on would be likely to appear out of focus to the shooter, thereby increasing the difficulty in following a moving target, particularly against a noncontrasting background.

SUMMARY OF THE INVENTION

Therefore an object of the subject invention is a gun sight which allows a target to be easily and rapidly sighted and tracked.

Another object of the subject invention is a gun sight which allows an accurate sight picture to be easily maintained during movement of the gun to align it on the target.

A still further object of the subject invention is the use of contrasting colors on the sight so that targets can be aimed at even under unfavorable lighting and vision conditions.

These and other objects are attained in accordance with the present invention wherein there is provided a gun sight having a direct linear sight path of contrasting colors between the rear sight and the front sight. A coventional rear notch sight is used to frame the front sight in aiming the gun. The front sight comprises a sighting surface on the gun barrel which is tapered, increasing in elevation along its length. A longitudinal center portion or stripe of the gun sight is colored to contrast with the adjacent parallel surfaces of the sight. In practice, a shooter visually links the two extremities of the sighting plane by framing the center stripe of the front sight within the rear sight. The contrasting colors in combination with the sight length facilitates the aiming of the gun and allows the target to be easily and quickly sighted and aimed. The center stripe, in a sense, orients the marksman's eye to the muzzle end of the sight while allowing the target to be simultaneously sighted. The front sight of the subject invention may be secured to any conventional gun with or without an existing sight, or it may be installed at the point of manufacture as original equipment. Appropriate attaching means may be used to position and secure the gun sight of the subject invention to the gun barrel.

DESCRIPTION OF THE DRAWINGS

Further objects of the invention, together with additional features contributing thereto and advantages accruing therefrom, will be apparent from the following description of one embodiment of the invention when read in conjunction with the accompanying drawings wherein:

FIG. 1 is a side view of a gun sight of one embodiment of the subject invention mounted on a conventional hand gun;

FIG. 2 is a side view of the gun sight of FIG. 1 with the interior in relief to show the means of mounting the gun sight on the gun barrel;

FIG. 3 is a top plan view of the gun sight of FIG. 1;

FIG. 4 is a front plan view of the gun sight of FIG. 1 looking down the muzzle of the gun;

FIG. 5 is a rear plan view of the subject invention showing the front and rear sights of FIG. 1 aligned for sighting on a target;

FIG. 6 is a cross section of the gun sight of the subject invention taken along the line 6—6 of FIG. 3;

FIG. 7 is an exploded view of the gun sight of FIG. 1 showing in detail the means of attachment of the sight to the mounting means and the mounting means to the gun barrel;

FIG. 8 is a side view of an alternative embodiment of the gun sight of the subject invention;

FIG. 9 is a cross section of the gun sight of FIG. 8 to better show the means for mounting the gun sight;

FIG. 10 is a front plan view of a gun sight of the subject invention taken along the line 10—10 of FIG. 8, showing the conformance and attachment of the inventive gun sight to the existing rib;

FIG. 11 is a side view of another alternative embodiment of the gun sight of the subject invention;

FIG. 12 is a bottom plan view of the alternative embodiment of the gun sight showing the tapered mount of the gun sight of FIG. 11;

FIG. 13 is a rear plan view of the alternative embodiment of FIG. 11 taken along the line 13—13 of FIG. 11, showing the tapered support legs; and, FIG. 14 is another cross section of the alternative embodiment taken along the line 14—14 of FIG. 8.

Referring now to FIG. 1 there is shown a hand gun 15 having a barrel 16. A rear sight 30 may be of conventional design having apertures 31. The gun sight of the subject invention 20 is attached to the barrel 16 by means of a sight base or mount 23. The gun sight 20 is preferably of a length corresponding to at least 20 percent or more of the distance between the rear sight and the muzzle, and preferably extending the length of the barrel. In FIG. 2 there is shown a side view of the gun sight 20, which has a tapered upper sighting surface extending from a maximum height near the muzzle to a minimum height at the point of the sight nearest the rear sight. This sighting surface is longitudinally bisected by a shallow portion or groove 22 (FIG. 3) of a contrasting color to that of the outer parallel longitudinal portions 21. The groove 22 extends on the sighting surface 21 from the rear or lower end of the sight 20 to a point spaced from the front or upper end 24 of the sight. Preferably, the colors used will be a white groove 22 on a black sighting surface 21. These colors generally provide the best contrast and will sufficiently improve a marksman's aim under the poorest of lighting conditions, usually dawn and dusk.

While the contrasting color is shown as being in a groove 22, the groove itself is not necessary and is not used in the sighting plane. The contrasting color serves to locate and line up the two extremities of the sighting plane. Thus, when the target is accurately framed by the sights, the target picture appears similar to conventional sights, with the exception of the existence of contrasting color in the center of the front sight. For this reason the contrasting color need not be found in a groove, but may be level with the sighting surface 21, as it would be were a white center surface laminated between two black surfaces, or were a white stripe merely painted on a black sighting surface. For instance, a white plastic plate could be sandwiched between two dark metal plates to provide the center contrasting color. Holes are drilled through the three plates for insertion of the pins to secure them to the sight mount.

As shown in FIG. 7, screws 35 may be used to secure the sight mount 23. The threaded portion of the screw passes through mount openings 38 into holes (not shown) tapped in the gun barrel for that purpose. Of course, other means of securing the sight base 23 to the gun barrel, such as a suitable adhesive or solder, may be employed. The sight 20 may be fixedly mounted within the sight base 23 with pins 36, by aligning the pin openings 37 and 39 in both the sight 20 and the base 23 and sliding the pins through the sight 20 until the pins are inserted into the openings 37 on the opposite side of the base 23. When installed in this manner, the sighting surface 21 will be elevated at the muzzle of the barrel 16, FIGS. 4 and 6.

When sighting on a target with the inventive gun sight through the rear sight 30, a conventional "H" relationship will be made when the rear sight aperture 31 and the frong sight 20 are properly aligned as in FIG. 5. The contrasting colors of the sighting surface 21 and the groove 22 enable the front sight to be quickly centered or framed within the rear sight aperture 31 and focused on the target, even under poor lighting conditions.

In another embodiment of the subject invention, the sight 120 may be secured to a gun having an existing conventional sight rib such as that found in a Ruger Security Six having the sight rib 100. As in the embodiment shown in FIGS. 1–7, the gun sight 120 of the subject invention has a front sight portion 124, a sighting surface 121 and a longitudinal groove 122 of a color contrasting with that of the sighting surface 121. To secure the gun sight 120 to the gun barrel 116, holes are drilled through the existing sight 100 and the existing sight rib 105. Corresponding openings are drilled in the gun sight 120. Through these openings, pins 136 are inserted and secured. The sight 120 may be secured either permanently or removably by well known means such as rivets for a permanent mount or nuts and bolts for a removable mount.

When securing the gun sight 120 of the subject invention to an already existing gun sight, care should be taken that the size of the existing sight 100 does not interfere with the placement of the inventive gun sight 120. For this reason, the gun sight mount 123 has a front portion 125 of decreased thickness. This portion 125 remains of a decreased thickness past that point where the elevation of the existing sight 100 tapers down to meet the sight rib 105. The opening 103 between the mount and the sight thereby created, allows the inventive gun sight 120 to be adapted to guns having varying existing sight lengths. Of course, the mount may be dispensed with if a laminated sight is used. In such a sight, the dark outer metal plates may be machined to provide shoulders for fitting over the sight while allowing for a spacing between the plates, and are tapered as described above. The center white plastic plate is formed to allow conformance with the taper of the outer plates. Pins are inserted through openings in the sandwiched plates to secure them directly to the gun barrel.

A still further embodiment of the subject invention involves the gun sight 220 which has a sighting surface 221 bisected by the groove 222 of a contrasting color. This sight 220 is shown mounted over the existing gun sight 200 and secured through openings in the sight 200 and the sight rib 205 by pins 236, as previously described. The gun mount 223 is made to adapt to a barrel of a Smith & Wesson Model 27 through the use of tapered support lands or legs 201. These lands 201 are tapered to fit the contours of the gun barrel thereby allowing for a secure fit of the sight 220 on the gun barrel of such a gun. However, a laminated gun sight may be used, if one wishes to dispense with the mount, as before.

Should one wish to convert a gun having fixed front and rear sights, a full-length rib may be mounted on the gun to provide an adjustable rear sight as well as the front sight of the subject invention. The full-length rib would be mounted as described above, being pinned through a hole drilled in the front sight and received near the rear sight by a screw.

Thus, it can be seen through the use of various gun sight mountings, the gun sight of the subject invention may be adapted to any fire arm, be it hand gun or rifle, to allow a sighting to be made upon the target as that shown in FIG. 5.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

I claim:

1. A sighting device for use on a gun permitting quick and accurate alignment and immediate firing of said gun at a target in a single continuous motion from a point well below eye level to a firing position at eye level, said gun having a barrel with a muzzle end, said sighting device comprising:

a rear sight mounted on the end of said gun opposite said muzzle end, said rear sight having an aperture forming a first sighting point;

an elongated front sight mounted on said barrel adjacent said muzzle end and extending a substantial distance toward said first sighting point, said front sight having a sighting tip of a first color disposed adjacent said muzzle end and forming a second sighting point of maximum height, said first and second sighting points being alignable to form a sighting plane along said barrel;

said front sight tapering uniformly from a maximum height at said sighting tip to a point of minimum height forming an elongated unobstructed tapered surface, said elongated tapered surface having a central surface strip of a second color adjacent outer surface strips of said first color, said central surface strip extending from said sighting tip to said point of minimum height, said first and second colors sharply contrasting to permit a user to quickly peripherally locate and continuously view said central strip and said sighting tip as said gun is raised from a position well below eye level to a firing position at eye level, thereby enabling the user to accurately align and fire said gun at said target without hesitation immediately as said gun reaches eye level.

2. The sighting device of claim 1 wherein said front sight extends at least 20 percent of the distance between said muzzle and said rear sight.

3. The sighting device of claim 1 wherein said first color is black and said second color is white.

4. The sighting device of claim 1 wherein said front sight is secured to said barrel by mounting means having tapered support legs for conformance to said barrel.

5. The sighting device of claim 1 wherein said front sight is mounted to said barrel by mounting means attaching to an existing gun sight.

* * * * *